United States Patent [19]

Drummond, Jr.

[11] 3,945,342

[45] Mar. 23, 1976

[54] MAGNETIC BRUSH SUPPORT MEMBER

[75] Inventor: Arthur Drummond, Jr., Walworth, N.Y.

[73] Assignee: Xerox Corporation, Stamford, Conn.

[22] Filed: Jan. 29, 1975

[21] Appl. No.: 544,977

Related U.S. Application Data

[62] Division of Ser. No. 414,015, Nov. 8, 1973, Pat. No. 3,893,815.

[52] U.S. Cl. ..... 118/637; 29/132

[51] Int. Cl.[2] ..... G03G 15/08

[58] Field of Search ..... 29/132; 427/18; 118/637

[56] References Cited

UNITED STATES PATENTS

| | | | |
|---|---|---|---|
| 2,062,317 | 12/1936 | Joseph | 29/132 |
| 3,246,629 | 4/1966 | Shelffo et al. | 118/637 |
| 3,364,545 | 1/1968 | O'Neal et al. | 29/132 |
| 3,447,221 | 6/1969 | Odiorne | 29/132 |
| 3,707,947 | 1/1973 | Reichart, Jr. | 118/637 |
| 3,863,603 | 2/1975 | Buckley et al. | 118/637 |

*Primary Examiner*—Mervin Stein
*Assistant Examiner*—Douglas Salser
*Attorney, Agent, or Firm*—Paul Weinstein; Clarence A. Green; James J. Ralabate

[57] ABSTRACT

A magnetic brush support member, the process of making it and a magnetic brush apparatus incorporating the support member are provided. The support member includes at least one surface for supporting a magnetic brush. The support member is formed of a composite comprising a metal binder component and a particulate second phase component. The second phase material is selected to have a greater abrasion resistance than the metal binder. A portion of the second phase protrudes from the metal binder at the support surface. The support member may be formed by casting or powder metallurgical techniques followed by removing a portion of the metal binder from the support surface to allow the second phase particles to protrude therefrom. Magnetic brush apparatuses adapted for cleaning or developing in electrostatographic machines are provided which include one or more of the magnetic brush support members.

7 Claims, 4 Drawing Figures

MAGNETIC BRUSH SUPPORT MEMBER

This is a division of application Ser. No. 414,015, filed 11/8/73, now U.S. Pat. No. 3,893,815, which issued July 8, 1975.

BACKGROUND OF THE INVENTION

This invention relates to a magnetic brush support member, the process of making it and a magnetic brush apparatus incorporating the support member. The support member is formed of a composite which imparts improved abrasion resistance to the surface of the member which supports the magnetic brush.

Magnetic brush apparatuses are employed in electrostatographic machines for a variety of purposes including developing and cleaning. U.S. Pat. No. 3,040,704 and 3,246,629 describe apparatuses used for developing electrostatic images. In the apparatuses described, the magnetic brush support member comprises a cylindrical sleeve which is rotatably supported about a stationary magnetic. The sleeve and magnet comprises a magnetic brush roll. When the roll is brought into operative contact with developer particles which include ferromagnetic particles, the particles are attracted to the surface of the cylindrical sleeve and arrange themselves thereon in the form of a brush. The brush is employed to bring toner particles which adhere to the ferromagnetic particles into contact with an electrostatic image in order to develop the image by transfer of the toner particles to the image areas so as to render them visible. It is apparent from the teachings of these patents that ferromagnetic particles of other similar metal particles used as a carrier in the developer exert an abrasive influence on the surface of the mag brush roll. Further, it is apparent, that it is desirable for the rolls to have a roughened surface so as to prevent the particles from slipping. Mechanically roughening the roll surface or cutting grooves, or knurls in the surface are inadequate since the number of bristle sites are restricted. Further the abrasive action of the carrier on the roll surface polishes down the surface roughness thereby reducing the effectiveness of the surface. The preferred metals for the sleeve are non-magnetic metals such as aluminum, brass and other relatively soft alloys and these are rapidly worn down by the abrasive action of the developer mix.

In accordance with the teachings of U.S. Pat. No. 3,246,629, a separate coating is provided on the surface of the non-magnetic sleeve which comprises a layer of particulate matter of powdered materials such as glass, ceramic, plastic and various metals including ferrous metals. The layer may be applied by adhering a layer of irregular particulate matter using a matrix of bonding adhesive or by flame spraying the particulate matter on the roll surface.

SUMMARY OF THE INVENTION

In accordance with this invention, a magnetic brush support member having a surface adapted to support a magnetic brush is provided as well as a magnetic brush apparatus incorporating the member. The support member in accordance with this invention, is formed of a composite material comprising a metal binder and a particulate second phase wherein the second phase comprises a material which has a greater abrasion resistance than the metal binder. The second phase is exposed at the surface of the support member which supports the magnetic brush. Preferably the metal binder comprises the matrix of the composite and the particulate second phase is dispersed therein.

The supporting member preferably is in the form of a roll and the second phase comprises particles of a highly abrasion resistant material such as oxides, carbides, nitrides, etc. The magnetic brush apparatus, in accordance with this invention, includes one or more magnetic brush support members as described above and is adapted for use as a developing or a cleaning apparatus.

A process of forming the support member also forms a part of the present invention. The process includes forming a magnetic brush support member of a composite comprising of a metal matrix and a dispersed particulate second phase as previously described followed by removal of a portion of the metal matrix from the surface of the member which is adapted to support the magnetic brush so that the second phase protrudes from the metal matrix. In the preferred process the composite member is formed by casting followed by etching of the support surface of the member to remove part of the metal matrix thereby leaving the second phase particles protruding from the surface of the metal matrix.

Therefore, it is an object of this invention to provide a magnetic brush support member formed of a composite having improved abrasion resistance.

It is a further object of this invention to provide a magnetic brush apparatus including one or more magnetic brush support members as above.

It is still a further object of this invention to provide a process of making magnetic brush support members from a composite as above.

These and other objects will become more apparent from a consideration of the following description and drawings.

DETAILED DESCRIPTION OF THE PREFERRED EMBODIMENTS

Figure 1:
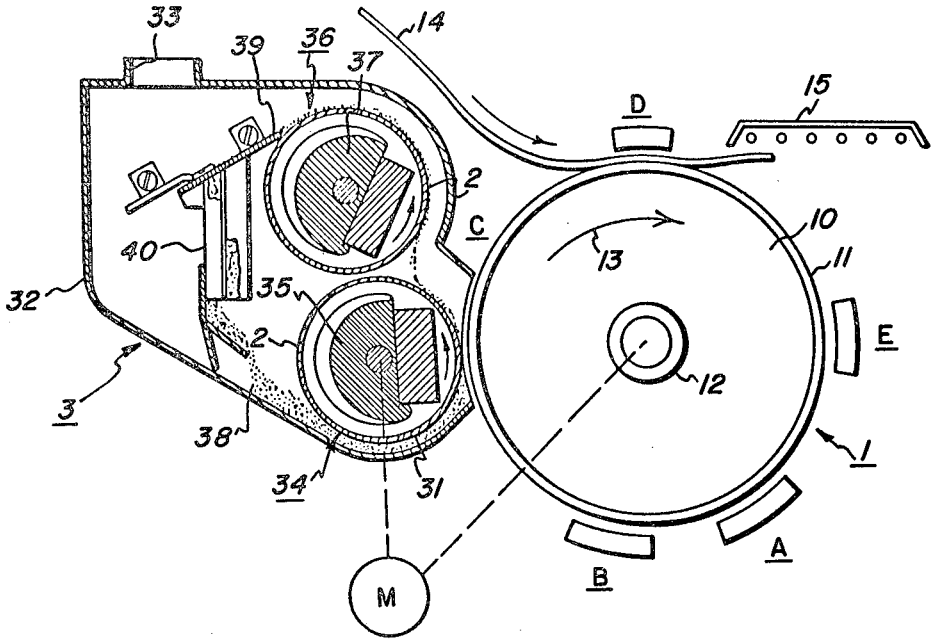
FIG. 1 is a schematic view of a reproducing apparatus incorporating a magnetic brush apparatus and magnetic support members in accordance with this invention.

Referring now to FIG. 1 there is shown by way of example an automatic xerographic reproducing machine 1 which incorporates the magnetic brush support member 2 and magnetic brush apparatus 3 of the present invention. The reproducing machine depicted in FIG. 1 illustrates the various components utilized therein for producing copies from an original. Although the magnetic brush support member 2 and magnetic brush apparatus 3 of the present invention are particularly well adapted for use in an automatic xerographic reproducing machine 1, it should become evident from the following description that they are equally well suited for use in a wide variety of processing systems including other electrostatographic systems and they are not necessarily limited in their application to the particular embodiment or embodiments shown herein.

The reproducing machine illustrated in FIG. 1 employs an image recording drum-like member 10, the outer periphery of which is coated with a suitable photoconductive material 11. One type of suitable photoconductive material is disclosed in U.S. Pat. No. 2,970,906 issued to Bixby in 1961. The drum 10 is suitably journaled for rotation within a machine frame (not shown) by means of shaft 12 and rotates in the direction indicated by arrow 13 to bring the image retaining surface thereon past a plurality of xerographic processing stations. Suitable drive means M are provided to power and coordinate the motion of the various cooperating machine components whereby a faithful reproduction of the original input scene information is recorded upon a sheet of final support material 14 such as paper or the like.

The practice of xerography is well known in the art and is the subject of numerous patents and texts including Electrophotography by Schaffert, published in 1965 and Xerography and Related Processes by Dessauer and Clark, published in 1965.

The various processing stations for producing a copy of an original are herein reprsented in FIG. 1 as blocks A to E. Initially, the drum 10 moves the photoconductive surface 11 through a charging station A. In the charging station A, an electrostatic charge is placed uniformly over the photoconductive surface 11 preparatory to imaging. The charging may be provided by a corona generating device of the type described in U.S. Pat. No. 2,836,725 issued to Vyverberg in 1958.

Thereafter, the drum 10 is rotated to exposure station B wherein the charged photoconductive surface 11 is exposed to a light image of the original input scene information whereby the charge is selectively dissipated in the light exposed regions to record the original input scene in the form of a latent electrostatic image. A suitable exposure system may be of a type described in U.S. Pat. No. 3,062,110 issued to Shepardson et al. in 1962. After exposure drum 10 rotates the electrostatic latent image recorded on the photoconductive surface 11 to development station C in accordance with the invention wherein a conventional developer mix is applied to the photoconductive surface 11 of the drum 10 rendering the latent image visible. A suitable development station is disclosed in U.S. Pat. No. 3,707,947 issued to Reichart in 1973. That patent describes a magnetic brush development system utilizing a magnetizable developer mix having ferromagnetic carrier granules and a toner colorant. The developer mix is brought through a directional flux field to form a brush thereof, the electrostatic latent image recorded on the photoconductive surface 11 is developed by bringing the brush of developer into contact therewith.

Further details of the development apparatus which comprises development station C will be described later by specific reference to the present invention.

The developed image on the photoconductive surface 11 is then brought into contact with the sheet 14 of final support material within a transfer station D and the toner image is transferred from the photoconductive surface 11 to the contacting side of the final support sheet 14. The final support material may be paper, plastic, etc. as desired.

After the toner image has been transferred to the sheet of final support material 14 the sheet with the image thereon is advanced to a suitable fuser 15 which coalesces the transferred powder image thereto. One type of suitable fuser is described in U.S. Pat. No. 2,701,765 issued to Codichini et al in 1955. After the fusing process the sheet 14 is advanced to a suitable output device.

Although a preponderance of the toner powder is transferred to the final support material 14, invariably some residual toner remains on the photoconductive surface 11 after the transfer of the toner powder image to the final support material. The residual toner particles remaining on the photoconductive surface 11 after the transfer operation are removed from the drum 10 as it moves through a cleaning station E. The toner particles may be mechanically cleaned from the photoconductive surface 11 by any conventional means as for example the use of a magnetic brush as set forth in U.S. Pat. No. 2,911,330 issued to Clark in 1959.

It is believed that the foregoing description is sufficient for purposes of the present application to illustrate the general operation of an automatic xerographic copier 1 which can embody the magnetic brush support member 2 and magnetic brush apparatus 3 in accordance with the present invention.

Figure 2:
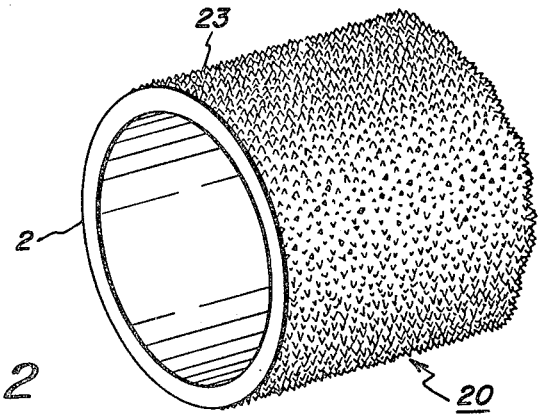
FIG. 2 is a perspective view of a magnetic brush roll in accordance with this invention.
Figure 3:
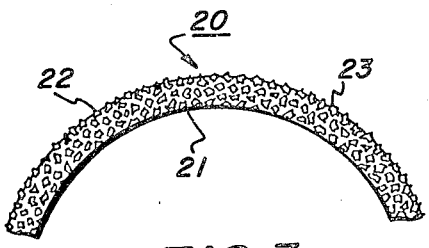
FIG. 3 is a partial cross-sectional view of a magnetic brush roll in accordance with this invention.

Referring now to FIGS. 2 and 3 a magnetic brush support member 2 in accordance with this invention is shown. The support member 2 shown comprises a cylindrical sleeve. The support member is not limited however, to the form of a cylindrical sleeve and it could have any desired shape adapted for use in supporting a magnetic brush. Therefore, for example, it could comprise a tubular type sleeve having any desired cross-section or it could comprise a belt or web type of element. In accordance with the present invention the support member 3 formed of a composite 20 which comprises a metal binder 2 component and a particulate second phase 22 component of a material having better abrasion resistance than the metal binder. In accordance with a preferred embodiment the metal binder component 2 comprises the matrix of the composite 20 and the second phase component is dispersed therein. Preferably, the particulate second phase 22 protrudes out from the metal matrix 21 at the supporting surface 23.

The size and density of the particulate second phase 22 is selected to give the appropriate surface roughness so that the member 2 provides a base on which can be produced a thick bristle like brush formation capable of developing dense visible images or in the alternative cleaning residual images in electrostatic apparatuses. The size and morphology of the particulate second phase 22 are generally in accordance with the teachings of U.S. Pat. No. 3,246,069 for the particles applied therein. Therefore, they should be in the range of from about 20 to about 500 microns along the largest dimensions. An average particle size of about 150 to about 300 microns is preferable. The particles need not be uniform in size and can vary over a ten-fold or larger range. The particles are preferably of an irregular shape with sharp or jagged edges as shown in FIG. 2.

Preferably, in accordance with this invention the particles 22 are formed of any desired material which is compatible with the metal binder component 21 and will not be totally dissolved therein and which possess sufficient abrasion resistance to provide a support member 2 having improved abrasion resistance. Therefore, particles such as carbides, oxides, nitrides, etc., such as for example, carbides of tungsten, molybdenum, titanium, etc., are particularly well-suited for use in accordance with this invention. Other particulate materials which can be used in accordance with this invention are set forth in U.S. Pat. No. 2,793,949, although the invention is not limited to the materials set forth therein.

The metal binder component 21 may be formed of any desired metal or alloy which is adapted to provide a magnetic brush supporting surfacce. For example, aluminum and its alloys, copper and its alloys, magnesium and its alloys, titanium and its alloys, nickel and its alloys, iron and steels, particularly stainless steels of the austenitic type (AISI 300 series (are well adapted for use as a binder component 21. It is preferable in accordance with this invention to alloys a metal binder component 21 comprising aluminum or its alloyss or copper and its alloys.

The composite material 20 in accordance with this invention can be formed of any well-known metallurgical technique as for example those illustrated in U.S. Pat. Nos. 2,793,949; 3,240,592; 3,574,609; and 3,468,658. In particular, U.S. Pat. No. 2,793,949 shows a method of preparing composite materials 20 in accordance with this invention and includes examples employing a wide variety of metal binder components 21 and second phase particulate components 22.

While the particular metallurgical approach employed for forming the composite material 20 in accordance with this invention may be conventional as previously described, the process of forming the magnetic brush support members 2 is quite novel. The process includes the steps of (1) forming the composite 20 into the desired support member 2 followed by (2) removing a portion of the metal binder over substantially the entire support surface 23 so that the particulate second phase 22 protrudes from the surface of the metal binder to provide a roughened support 23 as shown in FIG. 2.

Preferably, in accordance with this invention the removal step comprises etching the metal binder component to dissolve some of the metal around the particulate second phase 22 at the support surface 23. While etching comprises the preferred method in accordance with this invention for removing the portion of the metal binder component 21, other methods as are well-known in the art could be employed as, for example, grit blasting or other desired means for abrading the surface 23.

The step of forming the support member 2 preferably comprises a casting process wherein the support member is cast to its desired shape. The casting step itself may be carried out in accordance with prior teachings as, for example, those of U.S. Pat. No. 2,793,949. The use of a casting step to form the support member represents a marked improvement over the coating process described in U.S. Pat. No. 3,246,629 in that it enables better control of the dimensions of the outer periphery of the support member 2. It also provides for a strong band (mechanical or metallurgical as the case may be) between the particles 22 and the binder 21.

Figure 4:
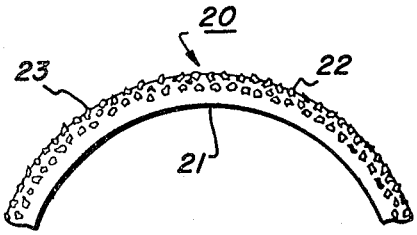
FIG. 4 is a partial cross-sectional view of a magnetic brush roll in accordance with another embodiment of the invention.

In accordance with a still more preferred embodiment of the present invention the casting step comprises a centrifugal casting process of a conventional nature such that the particulate second phase 22 is segregated toward the support surface 23 as shown in FIG. 4.

While casting comprises the preferred means for forming the support member 2 of this invention other means for forming the composite 20 into the support member 2 as are well-known in the art could be employed. For example, it is conventional practice in the art to form such composite materials by powder metallurgical techniques wherein powders or particles of the metal which is to form the binder 21 and of the second phase material 22 are mixed together and are then compressed and bonded into the desired final shape. Bonding of the mixture can be provided by sintering or by compressing the mixture at an elevated temperature. This process is particularly applicable for forming flexible shapes such as belts or the like since the composite material 20 may be formed into sheets by powder metallurgical techniques. U.S. Pat. No. 3,290,145 is exemplary of a powder metallurgy process which could be employed.

Referring to FIG. 3 a partial cross-section of a magnetic brush support member 2 in accordance with this invention is shown. The support member 2 shown in crosssection was formed by a conventional casting process without the aid of centrifugal force. As shown therein, the second phase particles 22 are substantially uniformly dispersed throughout the matrix 21 and a portion of the matrix metal has been removed from over substantially the entire support surface 23 so as to allow the particles to protrude therefrom.

As an example, the support member 2 shown in FIG. 3 could be formed of a composite comprising a matrix metal 21 such as aluminum, a particulate second phase 22 such as tungsten carbide. The etching step for removing the matrix metal from the support surface could then comprise applying boiling acetic acid to the surface which will attack the aluminum but not harm the tungsten carbide particles.

The casting parameters such as time, temperature and the like will, of course, depend on the particular composite 20 which is being employed; namely, the particular binder metal 21 and second phase material 22. The prior art patents referred to previously clearly give sufficient basis to enable one skilled in the art to select the appropriate casting parameters and additives if needed in order to obtain the desired composite material 20.

Having thus described the magnetic brush support member 2 in accordance with this invention and the process of making it, a magnetic brush development apparatus 3 incorporating the members 2 of this invention will now be described in detail by reference to FIG. 1. While the magnetic brush apparatus 3 described hereinafter comprises a development apparatus it could, if desired, also comprise a magnetic brush cleaning apparatus such as that described in U.S. Pat. No. 2,911,330. The apparatus 3 shown in FIG. 1 includes a storage portion or sump 31 in a housing 32 for storing the developer material and for enclosing the developer circulating system. The top of the housing 32 may include an opening 22 and could have a removable cover or cap (not shown). The system could include a toner dispenser (not shown) disposed over the opening 33 which periodically dispenses toner into the housing 32 in a manner similar to that taught in U.S. Pat. No. 3,608,792. Alternatively, the circulating system could be of the type where toner and/or toner plus carrier may be added periodically by an operator or an attendant to the machine 1. The development apparatus 3 includes magnetic brush rolls 34 and 36. The magnetic brush applicator roll 34 includes rotatably mounted support member 2 in accordance with this invention in the form of a cylindrical shell or sleeve and stationary permanent magnet 35 suspended within the sleeve 2. The magnetic field of the magnet 35 is oriented to form a brushlike structure. The brush roll 34 is immersed in the sump 31 of developer material 38 comprising ferromagnetic carrier particles and a toner colorant. The developer mix 38 is picked up by the outer support surface 23 of the roll 34 as it passes through the sump 31 and formed into a brush-like structure for application to the photoconductive surface 11 for development of the latent electrostatic image presented thereon. While only one applicator roll 34 is shown, any number of applicator rolls 34 could be employed as desired. Continued rotation of the roll 34 past the development zone brings the developer mix 38 into the field of a lifting magnetic brush roll 36. The lifting roll 36 attracts the developer mix 38 from the magnetic brush applicator roll 34 and carries it upward to be deposited on a slide 39 from which it flows into a cross-mixer 40 for return to the sump 31. The lifting roll 36 is also a magnetic brush roll and comprises a cylindrical sleeve support member 3 in accordance with this invention rotatably supported in the housing 32 and a fixed permanent magnet 37 supported in a stationary position within the sleeve. It is also possible in accordance with this invention to employ any desired number of lifting rolls 36. A magnetic brush roll as the term is employed in the present invention includes both applicator rolls and lifting rolls.

Further details of the apparatus 3 of FIG. 1 can be gained from a consideration of the aforenoted U.S. Pat. NO. 3,707,947. The preferred use for the magnetic brush members 2 in accordance with this invention is for applicator rolls 34 particularly those which are immersed in the sump 31 of developer material 38 since these rolls are subject to the greatest abrasionary forces.

Therefore, in accordance with this invention a magnetic brush apparatus 3 is provided which comprises one or more magnetic brush rolls 34 and 36 wherein the rolls include a magnetic brush supporting sleeve 2 movably supported in a housing 32. The sleeve 2, in accordance with invention, may be cylindrical as shown or it may have any other desired cross-sectional shape, as for example, the form of a belt or other endless configuration.

It is essential in accordance with this invention that the sleeve 2 be formed of a composite 20 which comprises a metal binder 21 having a particulate second phase 22 therein which as been previously described with reference to the magnetic brush support member 2. The magnetic brush apparatus of this invention basically comprises any of the conventional magnetic brush apparatuses heretofore known wherein the magnetic brush support surface 23 is formed of a composite as previously described.

The patents and texts referred to specifically in the detailed description of this application are intended to be incorporated by reference into the description.

It is apparent that there has been provided in accordance with this invention, a support member process and apparatus which fully satisfies the objects, means and advantages set forth hereinbefore. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirity and broad scope of the appended claims.

What is claimed is:

1. A magnetic brush apparatus including:

at least one magnetic brush support member having a surface adapted to support a magnetic brush including magnetic particles and means cooperating with said support member for providing a magnetic field for forming said brush, the improvement wherein; said magnetic brush support member is formed of a composite comprising a metal binder component and a particulate second phase component wherein: said second phase component is formed of a material which has a greater abrasion resistance than said metal binder and wherein a portion of said second phase component protrudes at said support surface from said metal binder.

2. An apparatus as in claim 1 wherein said second phase component is uniformly dispersed throughout said metal matrix.

3. An apparatus as in claim 1 wherein said second phase component is segregated toward the support surface of said member.

4. An apparatus as in claim 1 wherein said metal binder component is selected from a group consisting of aluminum, aluminum alloys, copper, copper alloys, nickel, nickel alloys, iron, and steels.

5. An apparatus as in claim 4 wherein said particulate second phase component is formed of a material selected from the group consisting of carbides, oxides and nitrides.

6. An apparatus as in claim 1 which includes a plurality of said support members.

7. An apparatus as in claim 1 which comprises a development apparatus for an electrostatographic machine.

* * * * *